US009200866B1

(12) United States Patent
Lin et al.

(10) Patent No.: US 9,200,866 B1
(45) Date of Patent: Dec. 1, 2015

(54) DUAL-BARREL AIR GUN AND BULLET DUCT SWITCHING DEVICE

(71) Applicant: SHANGHAI AIR GUN FACTORY, Pudong, Shanghai (CN)

(72) Inventors: Zhi Gang Lin, Shanghai (CN); Zhi Song Yu, Shanghai (CN)

(73) Assignee: SHANGHAI AIR GUN FACTORY, Shanghai (CN)

( * ) Notice: Subject to any disclaimer, the term of this patent is extended or adjusted under 35 U.S.C. 154(b) by 0 days.

(21) Appl. No.: 14/575,570

(22) Filed: Dec. 18, 2014

(30) Foreign Application Priority Data

Jun. 10, 2014 (CN) ..... 2014 1 0256404

(51) Int. Cl.
*F41B 11/72* (2013.01)
*F41B 11/721* (2013.01)

(52) U.S. Cl.
CPC ..... *F41B 11/721* (2013.01)

(58) Field of Classification Search
CPC ..... F41B 11/00; F41B 11/60; F41B 11/62; F41B 11/66; F41B 11/70; F41B 11/71; F41B 11/72; F41B 11/21; F41B 11/722; F41B 11/723; F41B 11/724; F41B 11/73; F41B 11/80
USPC ..... 124/59; 89/1.41
See application file for complete search history.

(56) References Cited

U.S. PATENT DOCUMENTS 614,878 A * 11/1898 Mefford ..... 124/73
2,623,226 A * 12/1952 Jones et al. ..... 15/104.062
3,612,026 A * 10/1971 Vadas et al. ..... 124/76
3,824,981 A * 7/1974 Crane et al. ..... 124/76
3,913,553 A * 10/1975 Braughler et al. ..... 124/73
4,349,200 A * 9/1982 Wakefield ..... 273/371
4,422,433 A * 12/1983 Milliman ..... 124/74
4,834,058 A * 5/1989 Gegere ..... 124/29
5,440,963 A * 8/1995 Szecsei ..... 89/1.41
5,494,024 A * 2/1996 Scott ..... 124/73
5,622,160 A * 4/1997 Casas Salva ..... 124/76
5,913,304 A * 6/1999 Johnson ..... 124/59
6,279,562 B1 * 8/2001 Clayton ..... 124/59
6,502,568 B2 * 1/2003 Kunimoto ..... 124/73
6,935,531 B1 * 8/2005 Clayton ..... 222/79
7,963,280 B2 * 6/2011 Maeda ..... 124/48
8,516,729 B2 * 8/2013 Hayes et al. ..... 42/69.01
8,863,421 B1 * 10/2014 Farage ..... 42/6
2004/0237952 A1 * 12/2004 Maeda et al. ..... 124/56
2004/0237953 A1 * 12/2004 Axelsson ..... 124/73
2005/0188976 A1 * 9/2005 Warnock ..... 124/73
2006/0266342 A1 * 11/2006 Teipel et al. ..... 124/74

(Continued)

*Primary Examiner* — Bret Hayes
*Assistant Examiner* — Derrick Morgan
(74) *Attorney, Agent, or Firm* — Hauptman Ham, LLP

(57) ABSTRACT

A dual-barrel air gun and a bullet duct switching device thereof are provided. The bullet duct switching device comprises a valve core, a locating plate and a locating structure; the valve core is rotationally connected to a gun body and with air channels through the locating plate along the central axis of the valve core; the valve core is at least provided with a first through-hole corresponding to one air channel; and the locating structure is disposed at the gun body and limits the rotation direction of the valve core. Using the dual-barrel air gun and the bullet duct switching device, barrels of different calibers can be configured on demand so different bullets can be used and the air gun shoot through any single barrel or two barrels; moreover, the dual-barrel air gun has the advantage that:barrel switching is more convenient and accurate, and two barrels are difficult to bend.

27 Claims, 13 Drawing Sheets

(56) References Cited

U.S. PATENT DOCUMENTS

2008/0257327 A1* 10/2008 Monks ..... 124/48
2009/0056692 A1* 3/2009 Maeda ..... 124/63
2009/0199833 A1* 8/2009 Li ..... 124/77
2014/0331984 A1* 11/2014 Brahler et al. ..... 124/76
2015/0059565 A1* 3/2015 Stewart ..... 89/1.41

* cited by examiner

DUAL-BARREL AIR GUN AND BULLET DUCT SWITCHING DEVICE

RELATED APPLICATIONS

The present application claims priority to Chinese Application No. 201410256404.7 filed on Jun. 10, 2014, the disclosure of which is hereby incorporated by reference herein in its entirety.

BACKGROUND OF THE INVENTION

1. Technical Field

The present invention relates to the field of air guns, in particular to a dual-barrel air gun and a bullet duct switching device thereof.

2. Description of Related Art

In the field of guns, no dual-barrel air gun appears at present, so the guns can only be matched with the bullets of proper calibers. In addition, for those skilled in this field, if an air gun structure with two barrels is used, such air gun has the problem that a single barrel has a smaller diameter and is easy to bend and deform, as well as the problem of lacking a device that can accurately and conveniently switch the required barrels to shoot from.

BRIEF SUMMARY OF THE INVENTION

The objective of the present invention is to provide a dual-barrel air gun and a bullet duct switching device to overcome the defects in the prior art. A dual-barrel air gun with two barrels and a bullet duct switching device for switching the barrels of the dual-barrel air gun are provided. Barrels of different calibers can be configured according to need, so the gun can shoot bullets of plural calibers, and shoot through any single barrel or both barrels according to need. Moreover, the present invention has the advantages that: the barrels are conveniently and accurately switched and the two barrels are difficult to bend.

The technical solution for realizing the above object is as follows:

A bullet duct switching device of the present invention is provided, comprising: a valve core, a locating plate and a locating structure; the valve core is rotationally connected to a gun body and connected with air channels through the locating plate along the central axis of the valve core, the valve core is at least provided with a first through-hole corresponding to one air channel; and the locating structure is disposed at the gun body and limits the rotation direction of the valve core.

The further improvement of the present invention lies in that said locating structure comprises a locating piece and one or plural notches formed at the upper part of the valve core; and the valve core is limited in the rotation direction through the locating piece and the notches.

The further improvement of the present invention lies in that, the locating piece comprises a rod portion and a stopper end formed at the end of the rod portion, and the shape of the stopper end is matched with the inner side of the notch.

The further improvement of the present invention lies in that, the locating structure also comprises a first spring; a first end of the first spring is connected to the gun body; a second end of the first spring presses the locating piece; the locating piece receives pressurization from the first spring and presses the circumference surface of the valve core where the notch is located along the radial direction of the valve core.

The further improvement of the present invention lies in that the rod portion has a lateral side or a bottom face formed with a pressing end, and the first spring is pressed between the pressing end and the gun body.

The further improvement of the present invention lies in that, the locating structure also comprises a backup plate; a first surface of the backup plate is fixed at the gun body; a second surface of the backup plate is matched with the first end portion of the first spring, and the first end of the first spring is connected with the gun body through the backup plate.

The further improvement of the present invention lies in that, the upper part of the valve core is formed with plural convex fins extending outward along the radial direction; the convex fins are distributed at intervals along the outer circumference of the valve core; the notch is formed at the convex fins, and the outer sides of the convex fins are matched with the stopper end.

The further improvement of the present invention lies in that, the rod portion is vertical to the air duct, and the notch is corresponding to the perpendicular bisector of the first through-hole.

The further improvement of the present invention lies in that the notches are V-shaped.

The further improvement of the present invention lies in that, the bottom face of the locating plate is formed with a projecting locating ring; the outer edges of convex fins are matched with the inner circle of the locating ring; and the locating ring is formed with an opening at a position corresponding to the stopper end.

The further improvement of the present invention lies in that, a first sealing ring is also included; the outer periphery of the valve core being recessed to form one or plural first ring slots; and the first sealing ring being respectively sleeved in the first ring slot.

The further improvement of the present invention lies in that the top of the valve core is formed with a rotary handle.

The further improvement of the present invention lies in that, the middle part of the locating plate is formed with a second through-hole and the rotating handle, and the rotating handle extends out through the second through-hole.

The further improvement of the present invention lies in that, the shape of the second through-hole is matched with the projection shape of the valve core in the axis direction, and when the first through-hole runs through the air channel, the second through-hole stops the valve core.

The further improvement of the present invention lies in that the valve core is formed with two the first through-holes that are vertical or parallel to each other.

A dual-barrel air gun of the present invention is provided, comprising a gun body, barrels connected to the gun body and a pneumatic mechanism, with the gun body forming the air channel; a first end of the air channel is connected with the pneumatic mechanism, and a second end of the air channel is connected with the bullet ducts of the barrels; the barrels and the air channels number 2 each. The dual-barrel air gun also comprises the bullet duct switching device of the present invention; the bullet duct switching device is connected with the air channels, and each air channel is switched on or off through the bullet switching device.

The further improvement of the present invention lies in that, the gun body is formed with a first mounting slot; the first mounting slot has an opening at one end and is connected with the air channel; and the valve core is rotationally disposed in the first mounting slot through the locating plate along the central axis of the valve core.

The further improvement of the present invention lies in that, the gun body is formed with a second mounting slot next to the opening of the first mounting slot; and the locating piece is disposed in the second mounting slot.

The further improvement of the present invention lies in that, the second mounting slot comprises a guide slot; the width of the guide slot is matched with the rod portion, and the rod portion is disposed in the guide slot.

The further improvement of the present invention lies in that the guide slot has an opening at the outer end.

The further improvement of the present invention lies in that, a sleeve is also included; the sleeve has a barrel hole along the length direction, the cross section of the barrel hole is shaped as two spheres with middle parts connected, and the sleeve is sleeved outside the two barrels through the barrel hole.

The further improvement of the present invention lies in that, a flat iron is also included; a first end of the flat iron forming a locating slot matched with the sleeve, a second end of the flat iron being formed with two third through-holes which are respectively matched with the two barrels, the locating slot being connected with the two third through-holes; the barrels extending out from the tube hole of the first end of the sleeve and being inserted and fixed in the third through-holes, the end portion and outer wall of the first end of the sleeve and being closely adhered to and fixed at the wall of the locating slot, respectively; and the barrels being connected with the gun body through the flat iron.

The further improvement of the present invention lies in that, the flat iron is pivoted with the gun body through a rotating shaft, and the flat iron and the gun body are located through a locating component.

The further improvement of the present invention lies in that the end portions of the barrels inserted in the third through-holes are each sleeved with a second sealing ring.

The further improvement of the present invention lies in that, the locating component comprises a movable dog, a second spring, a fixing piece and fixed dog; the flat iron is formed with a third mounting slot; the fixing piece, the second spring and the movable dog are disposed in the third mounting slot; the fixing piece and the third mounting slot are in fixed connection; the movable dog has a long slot in the middle part; the movable dog is fixed in the third mounting slot through a locating rod which is penetrated into the long slot; the second spring is pressed between the first end of the fixing piece and the first end of the movable dog; the fixed dog corresponds to the movable dog, the first end of the fixed dog is fixed at the gun body; the second end of the fixed dog and the second end of the movable dog are cone-shaped; and when the air channels are connected with the bullet duct, the upper surface of the second end of the movable dog is pressed and located by the lower surface of the second end of the fixed dog.

The further improvement of the present invention lies in that, the middle part of the first end of the fixing piece is formed with a boss matched with the inner diameter of the second spring; the periphery of the boss is recessed to form a second ring slot; the width of the second ring slot is matched with the line diameter of the second spring; and the first end of the second spring is pressed in the second ring slot and sleeved on the periphery of the boss.

The further improvement of the present invention lies in that, the first end of the movable dog is recessed to form a spring slot, and the second end of the second spring is pressed in the spring slot.

The further improvement of the present invention lies in that, the gun body comprises a female connector; the female connector comprises a connecting base and connecting plates that are each formed on two sides of the connecting base; the connecting base forms the first mounting slot, the air channel and the second mounting slot; the send end of the flat iron is inserted between and adhered to the connecting plates; the connecting plates and the second end of the flat iron form a fourth through-hole matched mutually, and the flat iron and the female connector are pivoted through the rotating shaft inserted in the fourth through-hole.

The present invention employing the above technical solution has the following beneficial effects:

The locating plate is used to rotationally connect the valve core to the gun body along the central axis of the valve core and locate the air channel of the gun body that is connected with the valve core; and the locating structure is used to limit the rotation direction of the valve core. The first through-hole is used to connect with the air channel. The locating plate, the locating structure and the valve core are mutually matched to realize control over the switching on and off of the air channels, thus realizing the switching of the air channels. The shape of the stopper end is matched with the inner sides of the notches such that the stopper end can be stably located in the notches after being inserted therein. Use of the first spring forces the locating piece to press the circumference surface of the valve core where the notches are located along the radial direction of the valve core, so when the notches rotate to be corresponding to the position of the stopper end of the locating piece, the stopper end is automatically clamped in and presses the notches, realizing location of the valve core by the locating piece. The first face of the backup plate is fixed at the gun body, and the second face of the backup plate is matched with the end portion of the first end of the first spring, thus preventing the deviation of the spring force direction of the first spring caused by the unevenness of the end portion of the first spring and ensuring that the first spring outputs the spring force along the radial direction of the valve core. The upper part of the valve core is formed with plural convex fins extending outward along the radial direction; the notches are formed on the convex fins. Use of the convex fins increases the compression degree of the first spring such that the first spring can provide a bigger spring force to the locating piece and ensure that the stopper end can be firmly fixed in the notches after being clamped in the notches, thus guaranteeing the location stability of the bullet duct switching device. The convex fins are distributed at intervals along the outer circle of the valve core, and recessed areas are formed between the convex fins. The recessed areas reduce the compression degree of the first spring, and then the spring provides a smaller spring force in those areas. In this way, the user can easily implement the rotation operation this area in the process of switching the bullet duct through rotating the valve core, and the operation of switching the bullet duct is more labor-saving. The outer sides of the convex fins are matched with the stopper end. The rod portion is vertical to the air channels, and the notches correspond to the position of the perpendicular bisector of the first through-hole. The notches are V-shaped, ensuring that the locating piece can automatically reciprocate close to the circumference of the valve core (if there are convex fins, including the outer edges of the convex fins) along the radial direction of the valve core when the valve rotates. The shape of the second through-hole is matched with the projection shape of the valve core in the central axis direction, so the valve core can be taken out through the second through-hole when rotating to the angle where its projection is corresponding to the shape of the second through-hole, and can also be fixed by the locating plate in the first mounting slot at an angle where its projection is not corresponding to the shape of the second through-hole. The two barrels, the two air channels and the bullet duct switching device are matched with one another in use, realizing the dual-barrel air gun capable of switching the air bullet duct. The first mounting slot is used to accommodate the valve core. The second mounting slot is used to accommodate the locating piece. The guide slot is used to accommodate the rod portion and guide the rod portion to move. The opening at the outer end of the guide slot ensures that there is enough space for accommodating the rod portion of the locating rod when the stopper end slides to the outer edges of the convex fins. Use of the sleeve increases the strength of the barrels and solves the problem that fine barrels are easily bent. The cross section of the barrel hole is shaped like two spheres with middle parts connected, and then the sleeve can generate flexible deformation through the barrel hole to match with the barrels when the diameters of the barrels have deviations, so exchange of the sleeve is not needed and costs are saved due to the high degree of universality. The flat iron is used for connection between the barrels and the gun body. The locating component is used to locate the flat iron and the gun body. The third mounting slot is used to install the fixing piece, the second spring and the movable dog. The second spring is used to push the movable dog out. The second spring is used in combination with the long slot such that the movable dog can shrink into the third mounting slot along the direction of the long slot when receiving a big enough external force and automatically extend out when not stressed and match with the fixed dog to realize the automatic location and clamping of the flat iron and the gun body after the barrels are filled with bullets and reset. The pneumatic mechanism is used to generate the pneumatic pressure to provide the power for shooting bullets.

DETAILED DESCRIPTION OF THE INVENTION

The invention is described in further detail with reference to the following embodiments.

Figure 1:
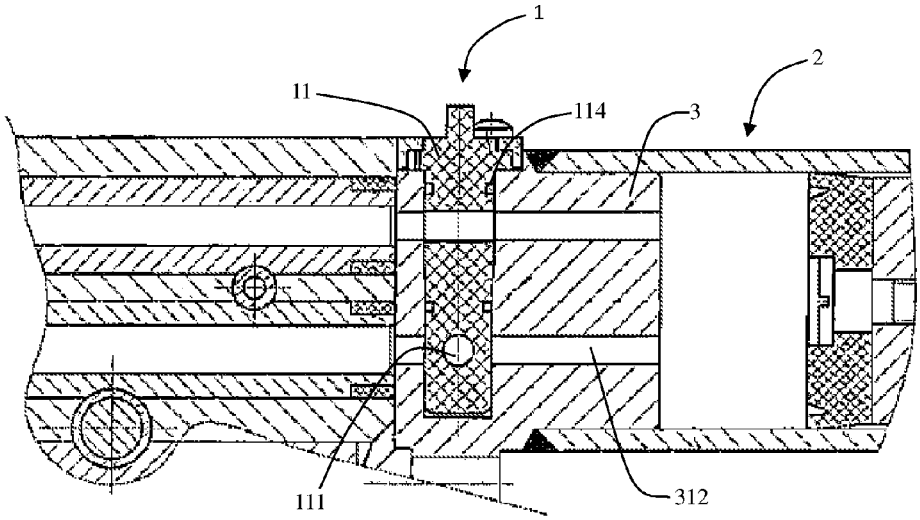
FIG. 1 is a schematic view of the connection structure of the bullet duct switching device and the gun body in the first embodiment of the present invention.
Figure 2:
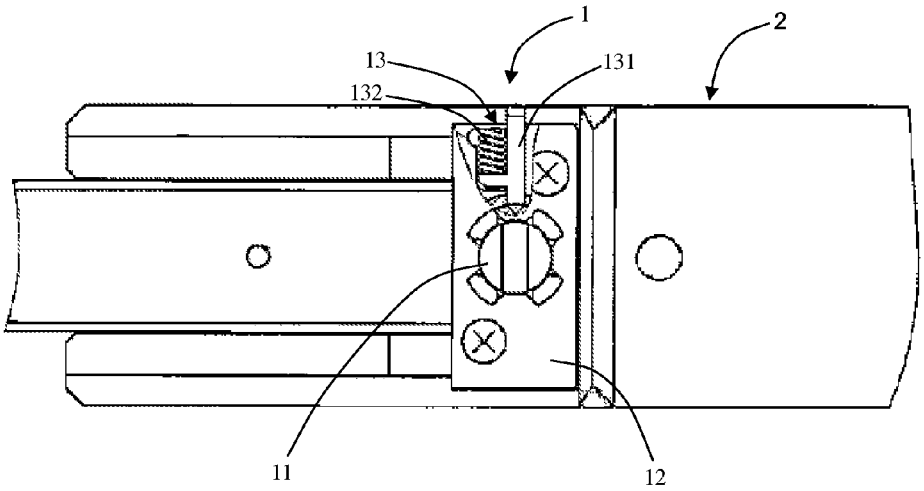
FIG. 2 is a top view of the connection structure of the bullet duct switching device and the gun body in the first embodiment of the present invention.
Figure 3:
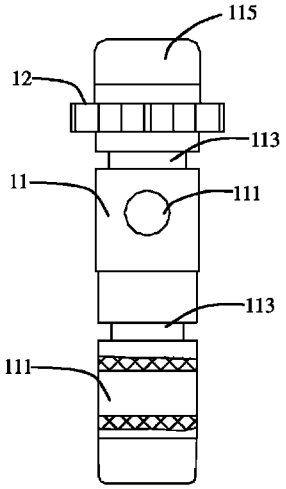
FIG. 3 is a structural view of the valve core in the first embodiment of the present invention.
Figure 4:
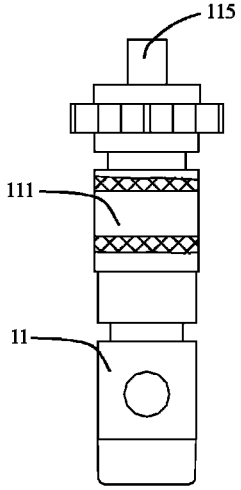
FIG. 4 is a lateral view of FIG. 3.

Refer to FIG. 1 and FIG. 2. A bullet duct switching device 1 in embodiment 1 of the present invention comprises a valve core 11, a locating plate 12 and a locating structure 13; the valve core 11 is rotationally connected to a gun body 2 along the central axis of the valve core 11 through the locating plate 12 and is connected with the air channels 312 of the gun body 2, and the valve core 11 is at least formed with a first through-hole 111 corresponding to one air channel 312. The locating structure 13 is used to limit the rotation direction of the valve core 11. The first through-hole 111 is used to connect with the air channel 312. The locating plate 12, the locating structure 13 and the valve core 11 are mutually matched to realize control over the switching on and off of the air channels 312, thus realizing the switching of the air channels 312.

Figure 5:
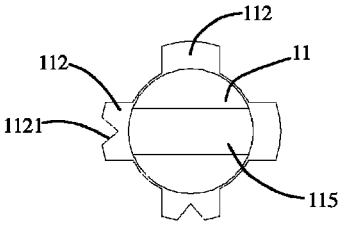
FIG. 5 is a top view of FIG. 3.
Figure 6:
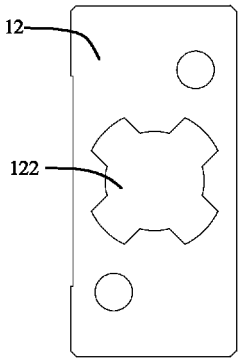
FIG. 6 is a structural view of the top surface structure of the locating plate in the first embodiment of the present invention.
Figure 7:
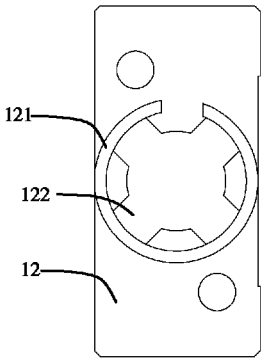
FIG. 7 is a structural view of the bottom surface structure of the locating plate in the first embodiment of the present invention.
Figure 8:
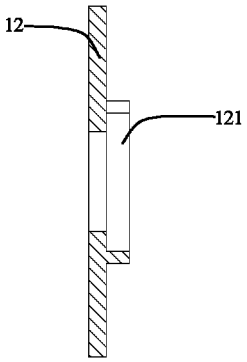
FIG. 8 is a structural view of the lateral section structure of the locating plate in the first embodiment of the present invention.
Figure 9:
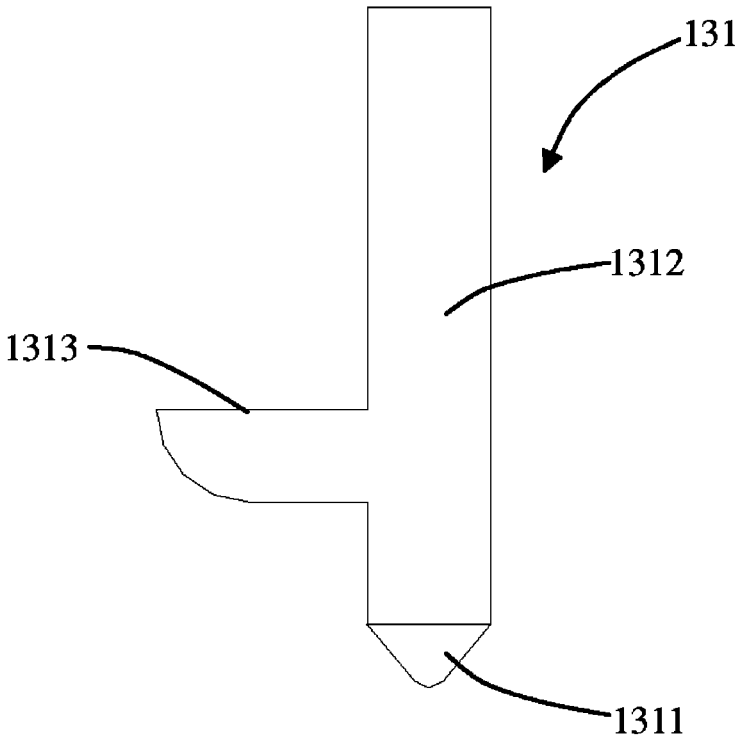
FIG. 9 is a structural view of the locating piece in the first embodiment of the present invention.
Figure 10:
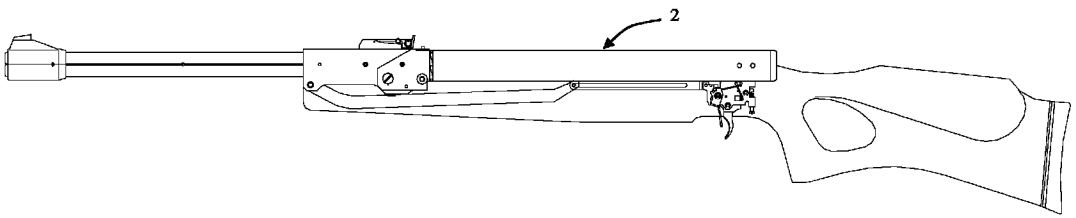
FIG. 10 is a schematic view of the general structure of the dual-barrel air gun in the first embodiment of the present invention.
Figure 11:
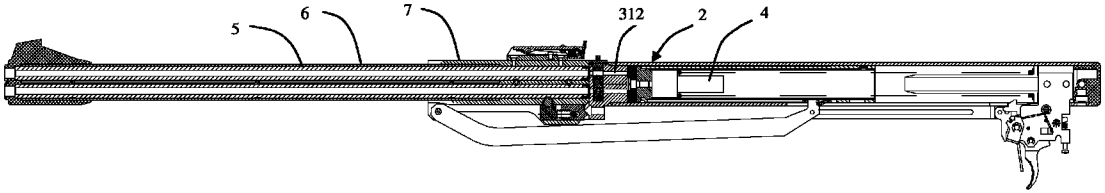
FIG. 11 is a schematic view of the inner structure of the dual-barrel air gun without the handle in the first embodiment of the present invention.
Figure 12:
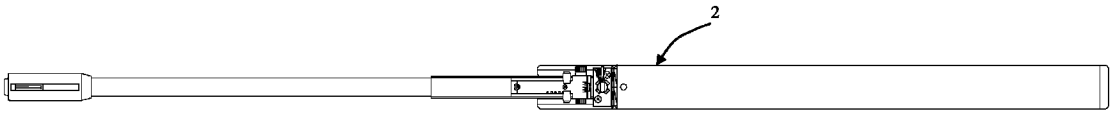
FIG. 12 is a top view of the inner structure of the dual-barrel air gun without the handle in the first embodiment of the present invention.
Figure 13:
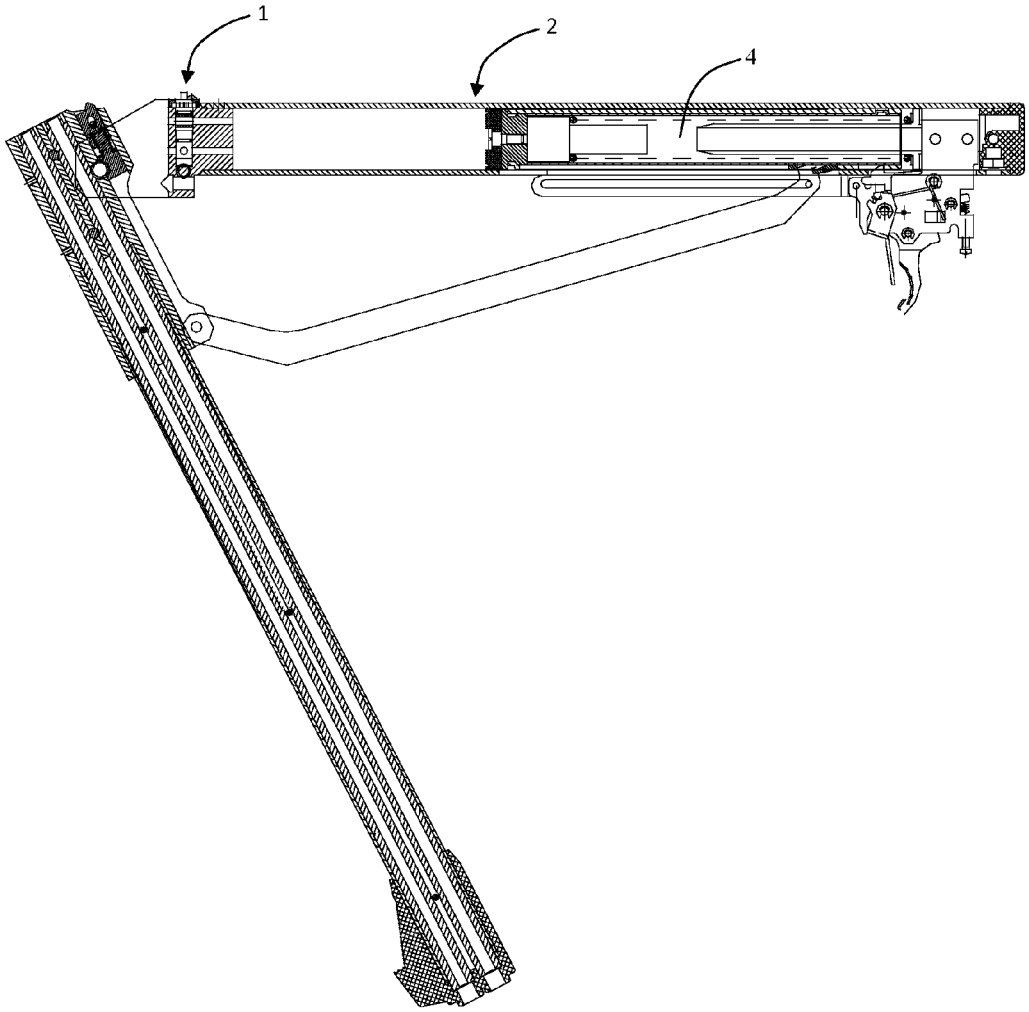
FIG. 13 is a top view of the bending structure for filling bullets of the dual-barrel air gun without the handle in the first embodiment of the present invention.

Refer to FIG. 2 and FIG. 5. In this embodiment, the locating structure 13 comprises a locating piece 131 and two notches 1121 which are formed at the upper part of the valve core 11 and correspond to the position of the perpendicular bisector of the first through-hole 111; and the valve core 11 is limited in the rotation direction through the locating piece 131 and the notches 1121. The locating structure 13 also comprises a first spring 132; the first end of the first spring 132 is connected with the gun body 2; the second end of the first spring 132 presses the locating piece 131; the locating piece 131 receives the pressure from the first spring 132 and presses the circumference surface of the valve core 11 where the notches 1121 are located along the radial direction of the valve core 11.

Use of the first spring 132 forces the locating piece 131 to press the circumference surface of the valve core 11 where the notches 1121 are located along the radial direction of the valve core 11, so when the notches 1121 rotate to be corresponding to the position of the stopper end 1311 of the locating piece 131, the stopper end 1311 is automatically clamped in and presses the notches 1121, realizing location of the valve core 11 with the locating piece 131.

Refer to FIGS. 1-5 and FIG. 9. In this embodiment, the valve core 11 forms two first through-holes 111 vertical to each other. The upper part of the valve core 11 is formed with plural convex fins 112 extending outward along the radial direction. The convex fins 112 are distributed at intervals along the outer circumference of the valve core 11. The notches 1121 are formed on the convex fins 112. The outer sides of the convex fins 112 are matched with the stopper end 1311. The notches 1121 are V-shaped. The outer periphery of the valve core 11 is recessed to form one or plural first ring slots 113. In this embodiment, two first ring slots 113 are formed; and the first sealing rings 114 are each sleeved in the first ring slots 113. The top of the valve core 11 forms a rotating handle 115.

Use of the convex fins 112 increases the compression degree of the first spring 132 such that the first spring 132 can provide a bigger spring force to the locating piece 131 and ensure that the stopper 1311 can be firmly fixed in the notches 1121 after being clamped in the notches 1121, thus guaranteeing the location stability of the bullet duct switching device 1; the convex fins 112 are distributed at intervals along the outer circumference of the valve core 11 to form recessed areas between the adjacent convex fins 112, and when the stopper end 1311 moves into the recessed area, the first spring 132 is compressed less and then provides a smaller spring force in this area. In this way, the user can easily implement the rotation operation this area in the process of switching the bullet duct through rotating the valve core 11, and the operation of switching the bullet duct is more labor-saving. The outer sides of the convex fins 112 are matched with the stopper end 1311, and the notches 1121 are V-shaped, ensuring that when the valve core 11 rotates, the locating piece 131 can automatically reciprocate close to the circumference of the valve core 11 (if there are convex fins 112 including the outer edges of the convex fins) along the radial direction of the valve core 11.

Refer to FIGS. 1, 2, 5 and 9. The locating piece 131 comprises a rod portion 1312 and a stopper end 1311 formed at the end of the rod portion 1312. The shape of the stopper end 1311 is matched with the inner sides of the notches 1121. One lateral side of the rod portion 1312 forms a pressing end 1313. The first spring 132 is pressed between the pressing terminal 1313 and the gun body 2. In this embodiment, the rod portion 1312 is vertical to the air channels 312. The shape of the stopper end 1311 is matched with the inner sides of the notches 1121 such that the stopper end 1311 can be stably located in the notches 1121 after being inserted therein.

Refer to FIG. 1 and FIGS. 5-9. The bottom face of the locating plate 12 forms a convex locating ring 121. The outer edges of the convex fins 112 are matched with the inner circle of the locating ring 121; and the locating ring 121 forms an opening at a position corresponding to the stopper end 1311. The middle form of the locating plate 12 is formed with a second through-hole 122, and the rotating handle 115 extends out via the second through-hole 122. The shape of the second through-hole 122 is matched with the projection shape of the valve core 11 in the axis direction, and when the first through-hole 122 switches the air channel 312, the edge of the second through-hole 122 limits the valve core 11. The locating plate 12 is used to rotationally connect the valve core 11 to the gun body 2 along the central axis of the valve core 11 and locate the air duct 312 of the gun body 2 that is connected by the valve core 11. In this embodiment, the shape of the second through-hole 122 of the locating plate 12 is at an angle of 45° to the projection shape of the valve core 11 in the central axis direction when the first through-hole 111 switches on the air channel 312.

The shape of the second through-hole 122 is matched with the projection shape of the valve core 11 in the central axis direction, so the valve core 11 can be taken out through the second through-hole 111 when rotating to the angle where its projection is corresponding to the shape of the second through-hole 122, and can also be fixed by the locating plate 12 in the first mounting slot 311 at an angle where its projection is not corresponding to the shape of the second through-hole 122.

The bullet duct switching device 1 of the present invention can be applied to guns using high pressure air for power, for example air guns, BB guns, paintball guns, and police guns.

Refer to FIGS. 10-13. A dual-barrel air gun of the present invention comprises a gun body 2, barrels 5 connected to the gun body 2 and a pneumatic mechanism 4; the gun body 2 forms air channels 312; the first end of each of the air channels 312 are connected with the pneumatic mechanism 4, and the second end of each of the air channels 312 can be connected with the bullet ducts of the barrels 5; and the barrels 5 and the air channels 312 number two each. The dual-barrel air gun also comprises the bullet duct switching device 1 of the present invention; the bullet duct switching device 1 is connected with the air channels 312; and the air channels 312 are switched on or off through the bullet duct switching device 1. The two barrels 5, the two air channels 312 and the bullet duct switching device 1 are matched with one another in use, realizing the dual-barrel air gun capable of switching the air bullet duct.

Figure 14:
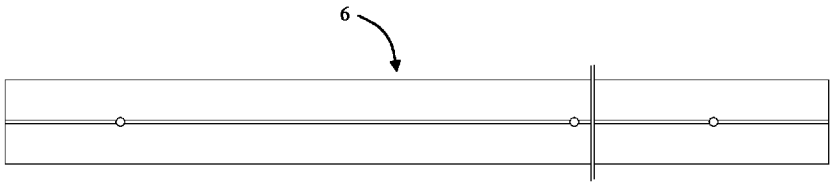
FIG. 14 is a structural view of the sleeve in the first embodiment of the present invention.
Figure 15:
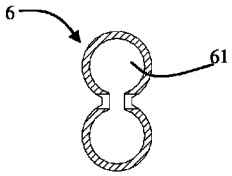
FIG. 15 is a sectional view of the sleeve in the first embodiment of the present invention.
Figure 17:
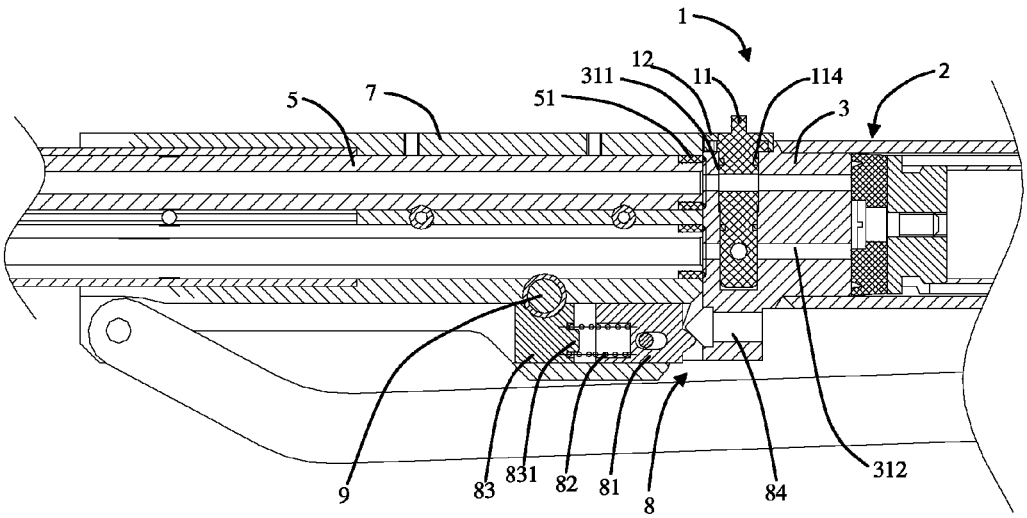
FIG. 17 is a schematic view of the structure that connects the flat iron with the barrels and the gun body in the first embodiment of the present invention.
Figure 18:
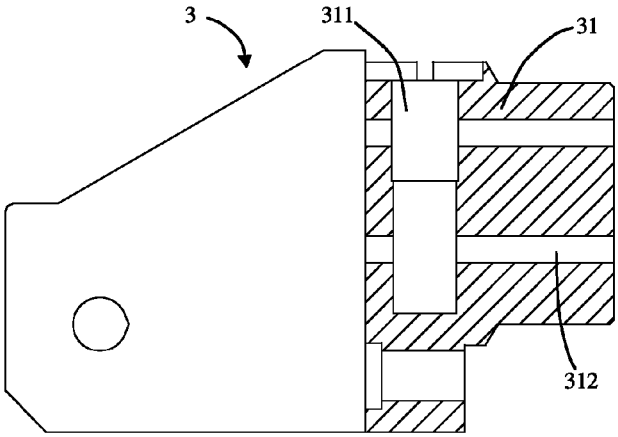
FIG. 18 is a structural view of the female connector in the first embodiment of the present invention.
Figure 19:
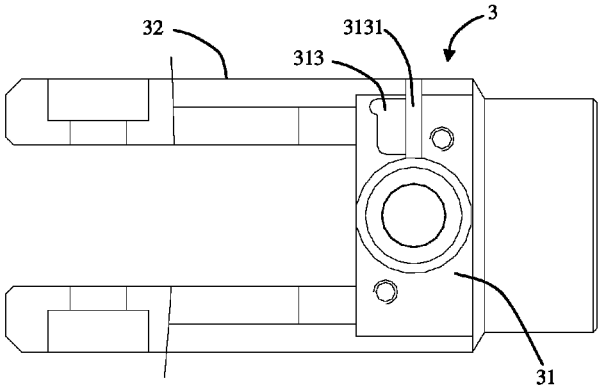
FIG. 19 is a top view of the structure of the female connector in the first embodiment of the present invention.
Figure 20:
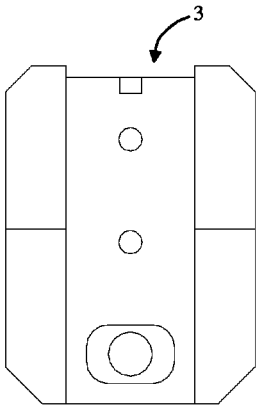
FIG. 20 is a lateral view of the structure of the female connector in the first embodiment of the present invention.
Figure 21:
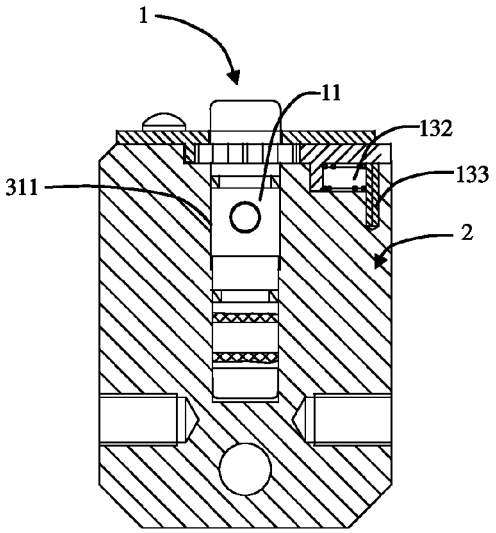
FIG. 21 is a schematic view of the connection structure of the bullet duct switching device and the gun body in the second embodiment of the present invention.
Figure 22:
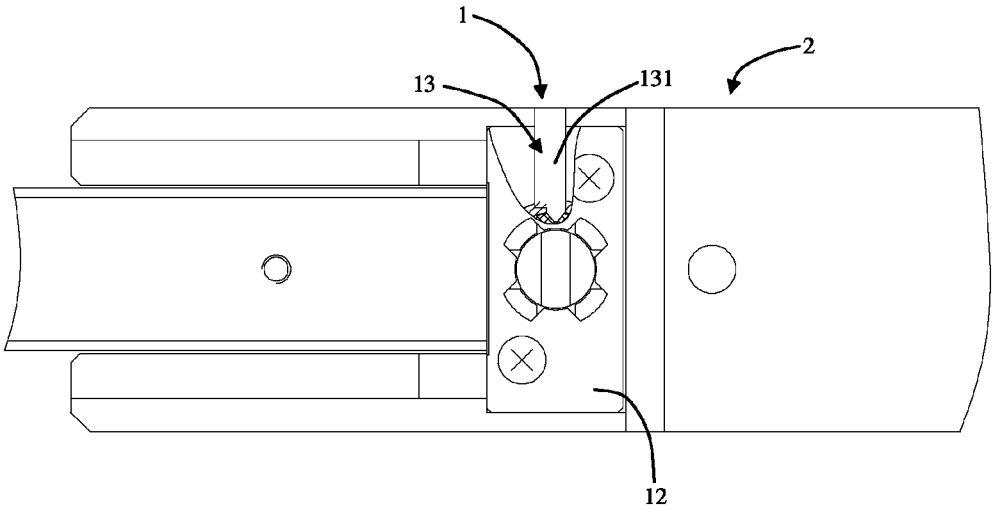
FIG. 22 is a top view of the connection structure of the bullet duct switching device and the gun body in the second embodiment of the present invention.
Figure 23:
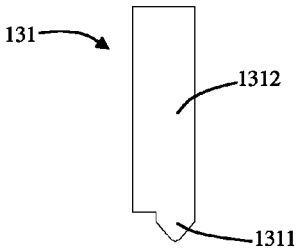
FIG. 23 is a top view of the structure of the locating piece in the second embodiment of the present invention.
Figure 24:
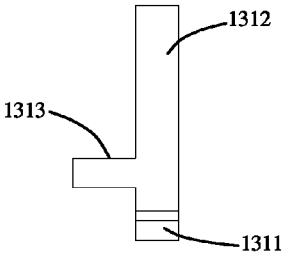
FIG. 24 is a lateral view of the structure of the locating piece in the second embodiment of the present invention.

Refer to FIGS. 14, 15 and 17. A sleeve 6 is also included. The sleeve 6 forms a barrel hole 61 along the direction of its length. The cross section of the barrel hole 61 is shaped like two spheres with middle parts connected. And the sleeve 6 is sleeved outside the two barrels 5 through the barrel hole 61. Use of the sleeve 6 increases the strength of the barrels 5 and solves the problem that fine barrels 5 are easily bent. The cross section of the barrel hole 61 is shaped like two spheres with middle parts connected, and then the sleeve 6 can generate flexible deformation through the barrel hole 61 to match with the barrels 5 when the diameters of the barrels 5 have deviations, so exchanging sleeve 6 is not needed and costs are saved due to the high degree of universality. The middle part of the female connector can be formed with pin holes and fastened by pin rods.

Figure 16:
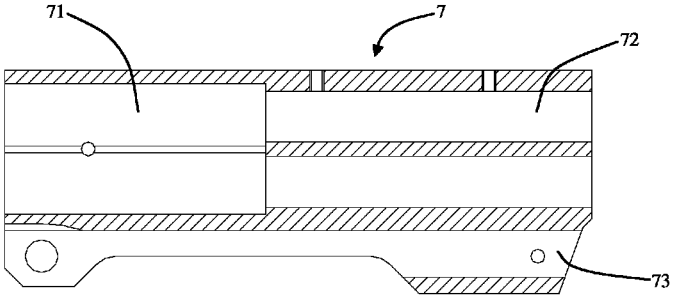
FIG. 16 is a structural view of the flat iron in the embodiment of the present invention.

Refer to FIGS. 16 and 17. A flat iron 7 is also included. The first end of the flat iron 7 forms a locating slot 71 matched with the sleeve 6, while the second end of the flat iron 7 forms two third through-holes 72 which are each matched with the two barrels 5. The locating slot 71 is connected with the two third through-holes 72. The barrels 5 extend out via the barrel hole 61 at the first end of the sleeve 6 and are inserted and fixed in the third through-holes 72, the end portion and the outer wall of the first end of the sleeve 6 are each adhered to and fixed at the wall of the locating slot 71; and the barrels 5 are connected with the gun body 2 through the flat iron 7.

The flat iron 7 is pivoted with the gun body 2 through a pivoting shaft 9. Moreover, the flat iron 7 and the gun body 2 are located through a locating component 8. The flat iron 7 is used to connect the gun barrels 5 and the gun body 2. The locating component 8 is used to locate the flat iron 7 and the gun body 2. The ends of the barrels 5 inserted in the third through-holes 72 are each sleeved with a second sealing ring 51.

The flat iron 7 and the sleeve 6 are matched with each other to bear the pressure generated when the barrels 5 are turned along the rotating shaft 9 in the bullet filling process and further prevent the barrels 5 from bending because of their being stressed.

The locating component 8 is comprised of a movable dog 81, a second spring 82, a fixing piece 83 and a fixed dog 84. The flat iron 7 forms a third mounting slot 73. The fixing piece 83, the second spring 82 and the movable dog 81 are disposed in the third mounting slot 73. The fixing piece 83 is fixedly connected with the third mounting slot 73. The movable dog 81 has a long slot in the middle part. The movable dog 81 is fixed in the third mounting slot 73 through the locating rod that is penetrated into the long slot. The second spring 82 is pressed between the first end of the fixing piece 83 and the first end of the movable dog 81. The fixed dog 84 corresponds to the movable dog 81, and the first end of the fixed dog 84 is fixed at the gun body 2. The second end of the fixed dog 84 and the second end of the movable dog 81 are cone-shaped. And, when the air channels 312 are connected with the bullet duct, the upper surface of the second end of the movable dog 81 is pressed and located by the lower surface of the second end of the fixed dog 84.

The third mounting slot 73 is used to install the fixing piece 83, the second spring 82 and the movable dog 81. The second spring 82 is used to push the movable dog 81 out. The second spring 82 is used in combination with the long slot such that the movable dog 81 can shrink into the third mounting slot 73 along the direction of the long slot when receiving a large enough external force, and automatically extend out when not stressed and match with the fixed dog 84 to realize the automatic location and clamping of the flat iron 7 and the gun body 2 after the barrels 5 are filled with bullets and reset.

The middle part of the first end of the fixing piece 83 forms a boss 831 matched with the inner diameter of the second spring 82; the outer periphery of the boss 831 is recessed to form a second ring slot; the width of the second ring slot is matched with the line diameter of the second spring 82; the first end of the second spring 82 is pressed in the second ring slot and is sleeved at the outer periphery of the boss 831.

The first end of the movable dog 81 is recessed to form a spring slot, and the second end of the second spring 82 is pressed in the spring slot.

Refer to FIGS. 5, 9, 17-20. In this embodiment, the gun body 2 comprises a female connector 3; the female connector 3 comprises a connecting base 31 and connecting plates 32 which are respectively formed on two sides of the connecting base 31; the connecting base 31 forms the first mounting slot 311, the air channels 312 and the second mounting slot 313; one end of the first mounting slot 311 has an opening and is connected with the air channels 312; and the valve core 11 is rotationally disposed in the first mounting slot 311 along the central axis of the valve core 11 through the locating plate 12. The second mounting slot 313 is formed next to the opening of the first mounting slot 311 (in other embodiments, the first mounting slot 311 and the second mounting slot 313 can be directly formed at the gun body 2); and the locating piece 131 is disposed in the second mounting slot 313. The second mounting slot 313 comprises a guide slot 3131; the width of the guide slot 3131 is matched with the rod portion 1312; and the rod portion 1312 is disposed in the guide slot 3131. The guide slot 3131 has an opening at the outer end. The guide slot 3131 is used to accommodate the rod portion 1312 and guide the rod portion 1312 to move. The opening at the outer end of the guide slot 3131 ensures that there is enough space for accommodating the rod portion 1312 of the locating rod 131 when the stopper end 1311 slides to the outer edges of the convex fins 112.

The second end of the flat iron 7 is inserted between the connecting plates 32 and adhered to the connecting plates 32. The connecting plates 32 and the second end of the flat iron 7 form a fourth through-hole matched mutually; moreover, the flat iron 7 and the female connector 3 are pivoted through the rotating shaft 9 in the fourth through-hole.

In this embodiment, the two barrels 5 are fixed on the flat iron 7; and the openings of the barrels 5 close to the gun body 2 are provided with the second sealing rings 51 on the periphery. The entire combination of the barrels 5, the sleeve 6 and the flat iron 7 can be dismantled at the same time for filling bullets. The structure of the dual-barrel air gun in the process of filling the bullets can refer to FIG. 13. When reset, the barrels 5 are jointed and connected with the air channels 312 of the female connector 3; the female connector 3 is equipped with a valve core 11; the valve core 11 is sleeved with two first sealing rings 114 for sealing; the locating plate 12 is fixed at the female connector 3 through screws; the V-shaped notches 1121 at the upper part of the valve core 11 are clamped by the stopper end 1311 of the locating piece 131; and the locating piece can be extended by the action of the first spring 132.

Refer to FIGS. 1, 5, 9 and 17. When the two first through-holes 111 of the valve core 11 are vertical to each other, the valve core 11 is sleeved with the first sealing ring 114 and inserted into the first mounting slot 311 and then rotates by 45°, and one notch 1121 of the valve core 11 is clamped by the stopper 1311. In such circumstances, one first through-hole 111 vertical to the locating piece 131 is connected with the corresponding air channel 312. Take one first through-hole 111 at the upper part of the valve core 11 that is connected with the air channel 312 as an example: one first through-hole 111 at the upper part of the valve core 11 is connected with an air channel 312 at the corresponding upper part; in such circumstances, the high pressure air impacts the bullet in one barrel 5 at the corresponding upper part through the connected air channel 312 at the upper part to shoot; at this moment, the other air channel 312 at the lower part is blocked by the valve core 11, and even if the barrel 5 at the lower part corresponding to the blocked air channel 312 is filled with the bullet, the bullet will not shoot through impact. When the valve core 11 rotates again by 90°, the other notch 1121 of the valve core 11 is clamped by the stopper end 1311. In such circumstances, one first through-hole 111 at the lower part is connected to one corresponding lower air channel 312, and the high pressure air impacts the bullet in one corresponding lower barrel 5 through the lower air channel 312 to short, and the upper air channel 312 is blocked, so even if there is a bullet in the barrel 5 at the upper part, the bullet will not short through impact.

In this embodiment, the diameter of the two barrels 5 may be set to be identical according to the requirements, or two barrels 5 with different diameters may be used. The two barrels 5 in this embodiment are arrayed in a longitudinal way. In other embodiments, the barrels can be transversely disposed upon demand. The valve core 11 can be shaped as a cylinder, cone, rectangle, oval, etc.

Refer to FIGS. 21-24. A bullet duct switching device 1 in the second embodiment of the present invention has a structure basically the same as that in embodiment, and is different in that: the bottom face of the rod portion 1312 extends outward to form the pressing end 1313. The locating structure 13 also comprises a backup plate 133; the first face of the backup plate 133 is fixed at the gun body 2; the second face of the backup plate 133 is matched with the end portion of the first end of the first spring 132; and the first end of the first spring 132 is connected with the gun body 2 through the backup plate 133. The first face of the backup plate 133 is fixed at the gun body 2, and the second face of the backup plate 133 is matched with the end portion of the first end of the first spring 132, thus preventing the deviation of the spring force direction of the first spring 132 caused by the unevenness of the end portion of the first spring 132 and ensuring that the first spring 132 outputs the spring force along the radial direction of the valve core 11.

Refer to FIGS. 4, 5, 9, 17 and 19. A bullet duct switching device in the third embodiment of the present invention has a structure basically the same as that in embodiment, and the difference lies in that: the valve core 11 forms two first through-holes 111 parallel to each other. When the two first through-holes 111 of the valve core 11 are parallel to each other, the valve core 11 is sleeved with the first sealing ring 114 and inserted into the first mounting slot 311 and then rotates by 45°, and one notch 1121 of the valve core 11 is clamped by the stopper end 1311. In such circumstances, the two first through-holes 111 are respectively connected with the corresponding air channels 312, and the dual-barrel air gun can shoot through the two barrels 5 at the same time.

A bullet duct switching device in the fourth embodiment of the present invention 1 has a structure basically the same as that in the first embodiment, and the difference lies in that: the valve core 11 only forms one first through-hole 111 corresponding to one air channel 312 111. In such circumstances, the valve core 11 only controls the switching on and off of the air channel 312 corresponding to the first through-hole 111, and the other air channel 312 is kept off.

A bullet duct switching device in the fifth embodiment of the present invention has a structure basically the same as that in the first embodiment, and the difference lies in that: the dual-barrel air gun comprises two bullet duct switching devices 1 of the present invention 1; the bullet duct switching devices 1 are respectively connected with an air channel 312, and the air channels 312 are switched on or off through the corresponding bullet duct switching devices 1.

The female connector 3 forms two first mounting slots 311; each first mounting slot 311 has an opening at one end and is connected with an air channel 312; two valve cores 11 are rotationally disposed in the corresponding first mounting slots 311 through a locating plate 12 along the central axis of the valve cores 11. The female connector 3 forms a second mounting slot 313 next to the opening of each of the two first mounting slots 311; and two locating pieces 131 are disposed in the corresponding second mounting slots 313. In such circumstances, each bullet duct switching device 1 can only control the on and off of the corresponding air channel 312.

The present invention is described in detail with reference to the attached drawings and the embodiments. Those ordinarily skilled in this field can make various modifications on the present invention according to the above description. Therefore, some details in the embodiments shall not constitute limitations on the present invention. The protective scope of the present invention is subject to the claims of the present invention.

What is claimed is:

1. A bullet duct switching device comprising:

a valve core, a locating plate and a locating structure;

said valve core being rotationally connected to a gun body and connected with two air channels through the locating plate along the central axis of the valve core, the valve core being provided with two first through-holes each corresponding to one of the said air channels;

said first through-holes being perpendicular to each other; and said locating structure being disposed on said gun body and limiting the rotation of said valve core; and wherein said air channels are switched between open and closed by the first through-holes of the valve core.

2. The bullet duct switching device according to claim 1, characterized in that, said locating structure comprises a locating piece and at least one notch formed at the upper part of said valve core; and said valve core is limited in said rotation direction through said locating piece and said at least one notch.

3. The bullet duct switching device according to claim 2, characterized in that, said locating piece comprises a rod portion and a stopper end formed at the end of the said rod portion, and the shape of said stopper end is matched with the inner side of said notch.

4. The bullet duct switching device according to claim 3, characterized in that, said locating structure also comprises a first spring; a first end of said first spring is connected to said gun body; a second end of said first spring presses said locating piece; said locating piece receives the pressurization from said first spring and presses the circumference surface of said valve core where said notch is located along the radial direction of said valve core.

5. The bullet duct switching device according to claim 4, characterized in that, said rod portion has a lateral side or a bottom face formed with a pressing end, and said first spring is pressed between said pressing end and said gun body.

6. The bullet duct switching device according to claim 5, characterized in that, said locating structure also comprises a backup plate; a first surface of said backup plate is fixed at said gun body; a second surface of said backup plate is matched with the first end portion of said first spring, and the first end of said first spring is connected with said gun body through said backup plate.

7. The bullet duct switching device according to claim 3, characterized in that, said the upper part of said valve core is formed with plural convex fins extending outward along the radial direction; said convex fins are distributed at intervals along the outer circumference of said valve core; said notch is formed at said convex fins, and the outer sides of said convex fins are matched with said stopper end.

8. The bullet duct switching device according to claim 7, characterized in that, said rod portion is vertical to said air duct, and said notch corresponds to the perpendicular bisector of said first through-hole.

9. The bullet duct switching device according to claim 8, characterized in that, said notch is V-shaped.

10. The bullet duct switching device according to claim 9, characterized in that, said the bottom face of said locating plate is formed with a projecting locating ring; the outer edges of convex fins are matched with the inner circle of said locating ring; and said locating ring is formed with an opening at a position corresponding to said stopper end.

11. The bullet duct switching device according to claim 10, characterized by also comprising a first sealing ring, with the outer periphery of said valve core being recessed to form one or plural first ring slots; and said first sealing ring being sleeved in said first ring slot.

12. The bullet duct switching device according to claim 11, characterized in that, said the top of said valve core is formed with a rotating handle.

13. The bullet duct switching device according to claim 12, characterized in that the middle part of said locating plate is formed with a second through-hole and said rotating handle, and said rotating handle extends out through said second through-hole.

14. The bullet duct switching device according to claim 13, characterized in that, said the shape of said second through-hole is matched with a projection shape of said valve core in an axis direction, and when one of said first through-holes is aligned with said air channel, said second through-hole stops said valve core.

15. A dual-barrel air gun, comprising:

a gun body, barrels connected to said gun body, a bullet duct switching device and a pneumatic mechanism, said gun body forming an air channel, the first end of said air channel being connected with said pneumatic mechanism, and the second end of said air channel being connected with bullet ducts of said barrels, said barrels and said air channels are each two in number;

the bullet duct switching device comprising:

a valve core, a locating plate, and a locating structure;

said valve core being rotationally connected to said gun body and connected with the two air channels through the locating plate along the central axis of the valve core, the valve core being provided with two first through-holes each corresponding to one of the said air channels;

said first through-holes being perpendicular to each other; and said locating structure being disposed on said gun body and limiting the rotation of said valve core; and wherein said air channels are switched on or off by said bullet duct switching device.

16. The dual-barrel air gun according to claim 15, characterized in that, said gun body forms a first mounting slot; said first mounting slot has an opening at one end and is connected with said air channels; and said valve core is rotationally disposed in said first mounting slot via said locating plate along its central axis.

17. The dual-barrel air gun according to claim 16, characterized in that, said gun body is formed with a second mounting slot next to the opening of said first mounting slot; and a locating piece is disposed in the second mounting slot.

18. The dual-barrel air gun according to claim 17, characterized in that, said second mounting slot comprises a guide slot; the width of said guide slot is matched with a rod portion of said locating piece, and said rod portion is disposed in said guide slot.

19. The dual-barrel air gun according to claim 18, characterized in that, said guide slot has an opening at the outer end.

20. The dual-barrel air gun according to claim 15, characterized by also comprising a sleeve, with said sleeve having a barrel hole along the direction of its length, the cross section of said barrel hole is shaped as two circles with middle parts connected, and said sleeve is sleeved outside said two barrels through said barrel hole.

21. The dual-barrel air gun according to claim 20, characterized by also comprising a flat iron, a first end of said flat iron being formed with a locating slot matched with said sleeve, a second end of said flat iron being formed with two third through-holes which are respectively matched with two said barrels, and said locating slot being connected with two said third through-holes; said barrels extending out from the tube hole of the first end of said sleeve and being inserted and fixed in said third through-holes, the end portion and outer wall of the first end of said sleeve and with each being closely adhered to and fixed at the wall of said locating slot; and said barrels being connected with said gun body through said flat iron.

22. The dual-barrel air gun according to claim 21, characterized in that, said flat iron is pivoted with said gun body through a rotating shaft, and said flat iron and said gun body are located through a locating component.

23. The dual-barrel air gun according to claim 22, characterized in that the end portions of the barrels inserted in said third through-holes are each sleeved with a second sealing ring.

24. The dual-barrel air gun according to claim 23, characterized in that said locating component comprises a movable dog, a second spring, a fixing piece and fixed dog; said flat iron is formed with a third mounting slot; said fixing piece, said second spring and said movable dog are disposed in said third mounting slot; said fixing piece and said third mounting slot are in fixed connection; said movable dog has a long slot in the middle part; the movable dog is fixed in said third mounting slot through a locating rod which is penetrated into said long slot; said second spring is pressed between the first end of said fixing piece and the first end of said movable dog; said fixed dog corresponds to said movable dog, the first end of said fixed dog is fixed at said gun body; the second end of said fixed dog and the second end of said movable dog are cone-shaped; and when the air channels are connected with the bullet duct, the upper surface of the second end of said movable dog is pressed and located by the lower surface of the second end of the fixed dog.

25. The dual-barrel air gun according to claim 24, characterized in that the middle part of the first end of said fixing piece is formed with a boss matched with the inner diameter of said second spring; the periphery of said boss is recessed to form a second ring slot; the width of said second ring slot is matched with the line diameter of said second spring; and the first end of said second spring is pressed in said second ring slot and sleeved on the periphery of said boss.

26. The dual-barrel air gun according to claim 25, characterized in that the first end of the movable dog is recessed to form a spring slot, and the second end of said second spring is pressed in said spring slot.

27. The dual-barrel air gun according to claim 26, characterized in that, said gun body is comprised of a female connector; said female connector is comprised of a connecting base and connecting plates which are each formed on two sides of said connecting base; said connecting base forms said first mounting slot, said air channel and said second mounting slot; the second end of said flat iron is inserted between and adhered to said connecting plates; said connecting plates and the second end of said flat iron form a fourth through-hole mutually matched, and said flat iron and said female connector are pivoted through the rotating shaft inserted in said fourth through-hole.

* * * * *